US011913322B1

(12) United States Patent
Aleid et al.

(10) Patent No.: US 11,913,322 B1
(45) Date of Patent: Feb. 27, 2024

(54) METHOD AND SYSTEM FOR MAXIMUM OIL RECOVERY IN A MULTI-PURPOSE WELL

(71) Applicant: SAUDI ARABIAN OIL COMPANY, Dhahran (SA)

(72) Inventors: Abdulrahman K. Aleid, Dhahran (SA); Wisam Shaker, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/938,610

(22) Filed: Oct. 6, 2022

(51) Int. Cl.
*E21B 43/38* (2006.01)

(52) U.S. Cl.
CPC ..... *E21B 43/38* (2013.01)

(58) Field of Classification Search
None
See application file for complete search history.

(56) References Cited

U.S. PATENT DOCUMENTS 8,505,627 B2 * 8/2013 Cox ..... E21B 43/385 166/266
2011/0168413 A1 * 7/2011 Bachtell ..... E21B 43/122 166/105.5
2017/0037716 A1 * 2/2017 Kohlik ..... E21B 43/2401
2022/0349283 A1 * 11/2022 Rabaa ..... E21B 43/123

FOREIGN PATENT DOCUMENTS

EP 1445420 A2 * 8/2004 ..... B04C 5/00
WO 2010096210 A1 8/2010

* cited by examiner

*Primary Examiner* — Charles R Nold
(74) *Attorney, Agent, or Firm* — Vorys, Sater, Seymour and Pease, LLP

(57) ABSTRACT

A production well system includes a main wellbore extending from a wellhead and penetrating a subterranean hydrocarbon-bearing formation, a lateral wellbore extending from the main wellbore, production tubing arranged within the main wellbore and in fluid communication with a production fluid present in the subterranean hydrocarbon-bearing formation, a separator arranged within the production tubing and operable to separate the production fluid into a hydrocarbon stream and a water stream, wherein the hydrocarbon stream is conveyed to the wellhead within the production tubing and the water stream is conveyed to the lateral wellbore, and a pump arranged uphole from the separator and operable to receive and convey the water stream into downhole portions of a lateral wellbore, thus creating a multi-purpose well which may reduce operating and capital expenditures while increasing production of existing and dead wells.

15 Claims, 2 Drawing Sheets

METHOD AND SYSTEM FOR MAXIMUM OIL RECOVERY IN A MULTI-PURPOSE WELL

FIELD OF THE DISCLOSURE

The present disclosure relates generally to oil recovery in the oil and gas industry and, more particularly, to the design of a multi-purpose well wherein the well may act as its own injector well, the separation of oil and water downhole within a multi-purpose well, and the injection of separated oil and/or surface water within a multi-purpose well.

BACKGROUND OF THE DISCLOSURE

In the operation of an oil and gas production well, production fluids derived from subterranean hydrocarbon formations flow up through production tubing and to surface extraction equipment for collection. However, upon drilling multiple production wells that intersect a given subterranean formation, or in the event of water breakthrough from subterranean aquifers, production fluids often contain varying amounts of water among the hydrocarbons. Due to this common occurrence, the surface extraction equipment often receives production fluid containing a mixture of hydrocarbons and water, and extraction of water-laden production fluid requires additional equipment for separating, processing and disposing of the water at the surface. This additional work, as well as the equipment for treatment and disposal, increase the capital and operating expenditures for the production well. As such, an alternative is needed for the removal and disposal of production fluid water prior to full extraction to the surface.

Further, the presence of large amounts of water may result in performance deterioration of the production well. As a result, the production well is often considered "dead" before extracting a desired amount of hydrocarbons. When a well is considered dead, the current practice is to workover the well for the installation of artificial lift equipment, or to re-drill and redesign the well, both of which may have large expenditures associated with them. Thus, an alternative is desirable for preventing the premature death of these wells through the proper handling of water within the well. Further, alternative practices for reviving dead wells while simultaneously handling water within the well are additionally desirable.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a production well system includes a main wellbore extending from a wellhead and penetrating a subterranean hydrocarbon-bearing formation, wherein the main wellbore is lined with a casing, and a lateral wellbore extending from the main wellbore and production tubing is arranged within the main wellbore and in fluid communication with a production fluid present in the subterranean hydrocarbon-bearing formation. The production well system further includes a separator arranged within the production tubing and operable to separate the production fluid into a hydrocarbon stream and a water stream, wherein the hydrocarbon stream is conveyed to the wellhead within the production tubing and the water stream is conveyed to the lateral wellbore, and a pump is arranged uphole from the separator within the lateral wellbore, the pump being operable to receive and convey the water stream into downhole portions of the lateral wellbore.

In another embodiment, a method includes receiving a production fluid from a subterranean formation into production tubing arranged within a main wellbore extending from a wellhead and penetrating the subterranean formation, wherein the main wellbore is lined with a casing, and separating the production fluid into a hydrocarbon stream and a water stream using a separator arranged within the production tubing. The method further includes conveying the hydrocarbon stream to the wellhead within the production tubing, conveying the water stream into a lateral wellbore extending from the main wellbore, and receiving and conveying the water stream into downhole portions of the lateral wellbore with a pump arranged uphole from the separator within the lateral wellbore.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
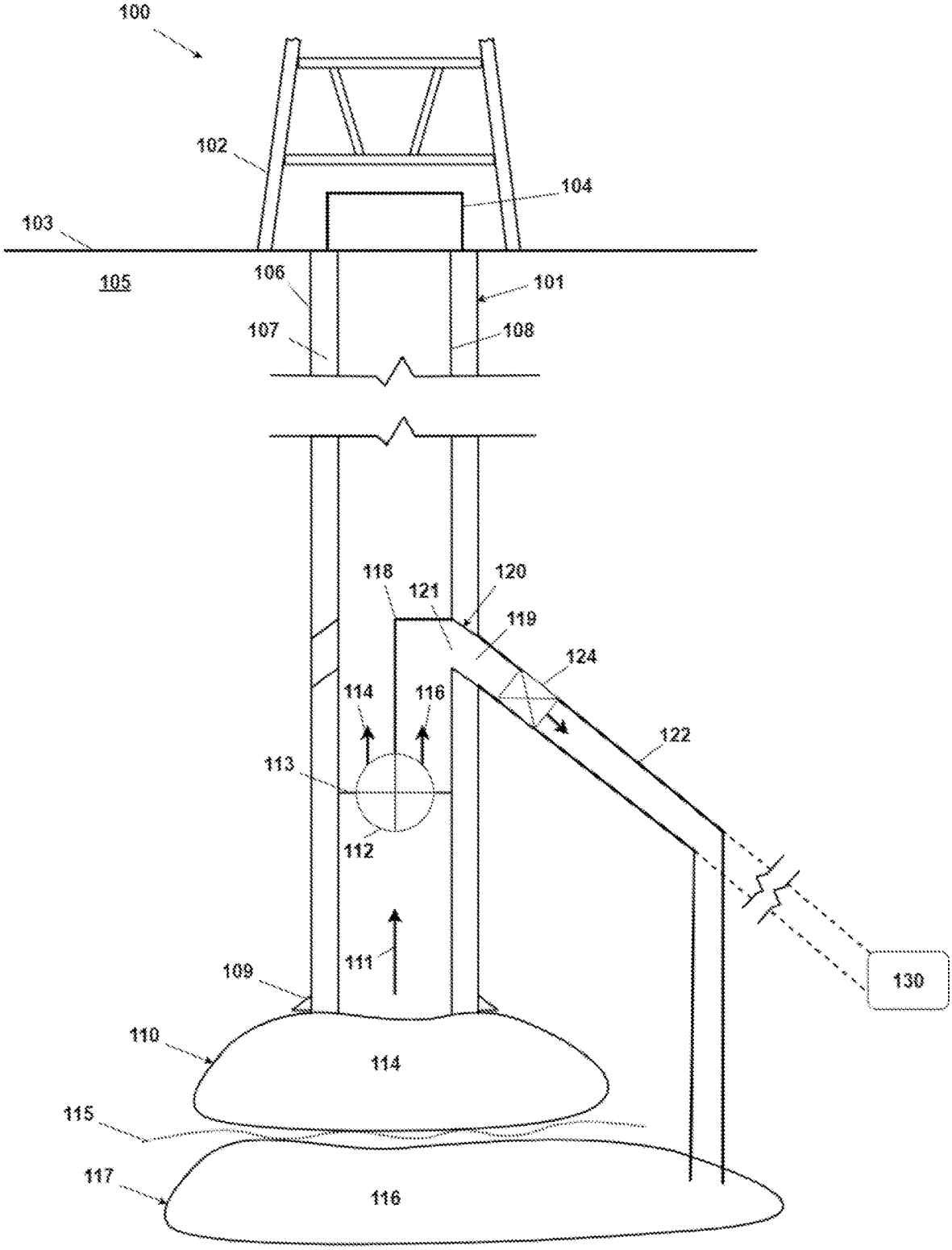
FIG. 1 is a schematic of an example production well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to oil recovery in a multi-purpose well and, more particularly, to separation of oil and water downhole within a multi-purpose production well. The embodiments described herein may be useful in helping reservoir engineers recover maximum oil value from a well by utilizing downhole separator systems designed to separate hydrocarbons (e.g., oil) and water within the wellbore. The systems described herein allow the separated hydrocarbons to travel to the well surface while redirecting the separated water back to a subterranean water source, such as an aquifer, via a lateral or sidetrack wellbore that may be equipped with a water pump. The systems described herein may be able to help revive dead wells due to low/moderate water cut but still exhibiting high surface back pressure. Moreover, the presently described systems help avoid producing large amounts of water to the surface, but instead utilize a downhole path as a water disposal means that will save natural energy on location.

FIG. 1 is a schematic of an example production well system 100 that may incorporate the principles of the present disclosure. As illustrated, the production well system 100 (hereafter "the system 100") can include a derrick 102 and a wellhead 104, each arranged at a surface 103 of the earth 105. A main wellbore 101 extends from the wellhead 104 into the earth 105 and intersects at least one subterranean formation 110. The wellhead 104 may include surface extraction equipment designed to extract and process a production fluid 111 from the subterranean formation 110.

In some applications, at least a portion of the main wellbore 101 may be lined with a liner or casing 106. In such embodiments, the casing 106 may terminate with a casing shoe 109. In other embodiments, however, the casing 106 may be omitted and the wellbore 101 may be characterized as an "open-hole" wellbore, without departing from the scope of the disclosure. Production tubing 108 is anchored to and extends from the wellhead 104 within the wellbore 101, and an annulus 107 is defined between the inner wall of the wellbore 101 (e.g., the casing 106) and the production tubing 108. In one or more embodiments, both the casing 106 and the production tubing 108 may extend to the subterranean formation 110, but in other embodiments, only the production tubing 108 extends to the subterranean formation 110. The production tubing 108 may extend sufficiently to fluidly communicate with the production fluid 111 from the subterranean formation 110.

The production fluid 111 may comprise a mixture of both oil and water. In some embodiments, for instance, the subterranean formation 110 may comprise an oil reservoir which has been impregnated with water through early water breakthrough originating from a subterranean water source 117. The subterranean water source 117 may comprise, for example, an aquifer, an underground lake, an underground river, or any other formation in which the majority of the fluid content is water rather than hydrocarbons. Over time, and with high reservoir pressure drawdown, high-permeability paths from the subterranean water source 117 to the well trajectory, often referred to as "water coning," may penetrate an oil/water interface 115 formed between the subterranean formation 110 and the subterranean water source 117. In such cases, the water content may be minimal, but nonetheless of an amount wherein removal may be necessary or desired.

The system 100 may further include a separator 112 arranged within the production tubing 108 at a location uphole from the subterranean formation 110. The production fluid 111 that enters the production tubing 108 may eventually reach the separator 112, which may be configured to separate hydrocarbons 114 present within the production fluid 111 from water 116. The separator 112 may comprise any type of downhole separation device or mechanism capable of separating the hydrocarbons 114 from the water 116 within the production fluid 111 within an acceptable threshold. For example, the separator 112 may comprise, but is not limited to, a hydro-cyclonic or centrifugal separator, a gravity-based separator, a semi-permeable filter, or any combination thereof.

In some embodiments, the separator 112 may be sized and otherwise configured to generate a sealed interface 113 against the inner walls of the production tubing 108. In such embodiments, the sealed interface 113 may prevent the production fluid 111 from flowing around the separator 112 and instead direct the production fluid 111 to flow through the separator 112. The sealed interface 113 may comprise any type of sealing device or mechanism capable of generating a sealed engagement, and may be installed mechanically, hydraulically, or may be formed using expandable materials.

The hydrocarbon stream 114 discharged from the separator 112 may be referred to as a "dry oil," or oil that is substantially free of water 116. The hydrocarbon stream 114 may be conveyed to the wellhead 104 at the surface 103 via the production tubing 108. At the wellhead 104, because the hydrocarbons 114 have already been substantially separated from the water 116 in the separator 112, there may be little or no need for surface treatment to remove any additional water 116 from the recovered hydrocarbons 114 or for the disposal of water 116 at the surface 103.

The water 116 discharged from the separator 112 may be referred to as a "water stream," or water that is substantially free of hydrocarbons 114. According to one or more embodiments, the water stream 116 may be discharged from the separator 112 and conveyed to a lateral wellbore 122 extending from the main wellbore 101. The lateral wellbore 122, also referred to as a "side-track" wellbore, may extend from the wellbore 101 at any angle. As illustrated, the system 100 may further include a guide 118 in fluid communication with the discharge end of the separator 112 and configured to receive and convey (direct) the water stream 116 discharged from the separator 112 to the lateral wellbore 122. More specifically, the guide 118 may fluidly communicate with a hole 121 defined in the production tubing 108, and the production tubing 108 may be arranged such that the hole 121 axially aligns with an aperture 119 defined in (through) the casing 106. The aperture 119 may be defined and otherwise formed upon drilling the lateral wellbore 122, for example.

The guide 118 may comprise any structure, mechanism, or device exhibiting any configuration or design capable of conveying the water stream 116 discharged from the separator 112 to the hole 121 in the production tubing 108. In some embodiments, for example, the guide 118 may comprise a hemi-cylindrical structure configured to occupy a portion (e.g., half) of the interior of the production tubing 108 as extended from the separator 112. In other embodiments, however, the guide 118 may comprise a pipe, a conduit, or other type of tubing fluidly coupled to the separator 112 and extending to the hole 121. Those skilled in the art will readily appreciate that the guide 118 is not limited to a hemi-cylindrical structure exhibiting a semicircular cross-section, or a pipe, a conduit, or tubing extending from the separator 112, but may alternatively exhibit other configurations or shapes capable of maintaining the separation of the water stream 116 from the hydrocarbon stream 114, without departing from the scope of this disclosure.

The guide 118 may extend to and otherwise mate with the hole 121 defined in the production tubing 108. In some embodiments, the guide 118 may generate a sealed engagement with the hole 121. An annulus guide 120 may be arranged within the annulus 107 and may be configured to extend between and fluidly connect the hole 121 with the aperture 119 such that the water 116 discharged from the separator 112 is able to be conveyed into the lateral wellbore 122. In some embodiments, the annulus guide 120 may comprise an isolation packer or the like. In such embodiments, the isolation packer may be installed mechanically, hydraulically, or may be formed using expandable materials. In other embodiments, however, the annulus guide 120 may comprise a pipe, a conduit, or other type of tubing extending between the hole 121 and the aperture 119. In at least one embodiment, the annulus guide 120 may form part of the guide 118. In such embodiments, the annulus guide 120 may comprise an extension of the guide 118 sized to extend through the hole 121 and the annulus 107, and subsequently locate and mate with the aperture 119. In an embodiment, the annulus guide 120 may be configured to create an isolated portion through which the water stream 116 may exit the main wellbore 101 and enter the lateral wellbore 122.

The system 100 may further include a pump 124 arranged uphole from the separator 112. In at least one embodiment, as illustrated, the pump 124 may be arranged within the lateral wellbore 122, but could alternatively be arranged within portions of the main wellbore 101. The pump 124 is considered arranged uphole from the separator 112 in the sense that it receives the water stream 116 from the separator 112. The pump 124 may be configured to receive and convey the water 116 into downhole portions of the lateral wellbore 122. The pump 124 may comprise any type of pump or pumping apparatus capable of pumping the water 116 in a downhole environment. Examples of the pump 124 include, but are not limited to, a centrifugal pump, a positive displacement pump, or any combination thereof.

In some embodiments, the lateral wellbore 122 may be drilled to intersect the subterranean water source 117. In such embodiments, the pump 124 may be configured to convey the water 116 back to the subterranean water source 117, and the reinjection of the water 116 into the subterranean water source 117 may create lift within production fluids 111 as the water level, and therefore, the oil/water interface 115, rises with the reinjected water 116. In some applications, however, the lateral wellbore 122 may be used to redirect or dispose of the water 116 without providing lift within the system 100. For example, the lateral wellbore 122 may instead be drilled to connect to a separate downhole location 130 (shown in dashed lines) such as, but not limited to, a secondary water source, a secondary production well, or any combination thereof. In any embodiment, separating the water 116 downhole and pumping the separated water stream 116 through the lateral wellbore 122 with the pump 124 may be advantageous in saving natural energy downhole, as energy is not wasted by conveying the water stream 116 to the surface 103 or processing and relocating the water 116 at the surface 103.

Figure 2:
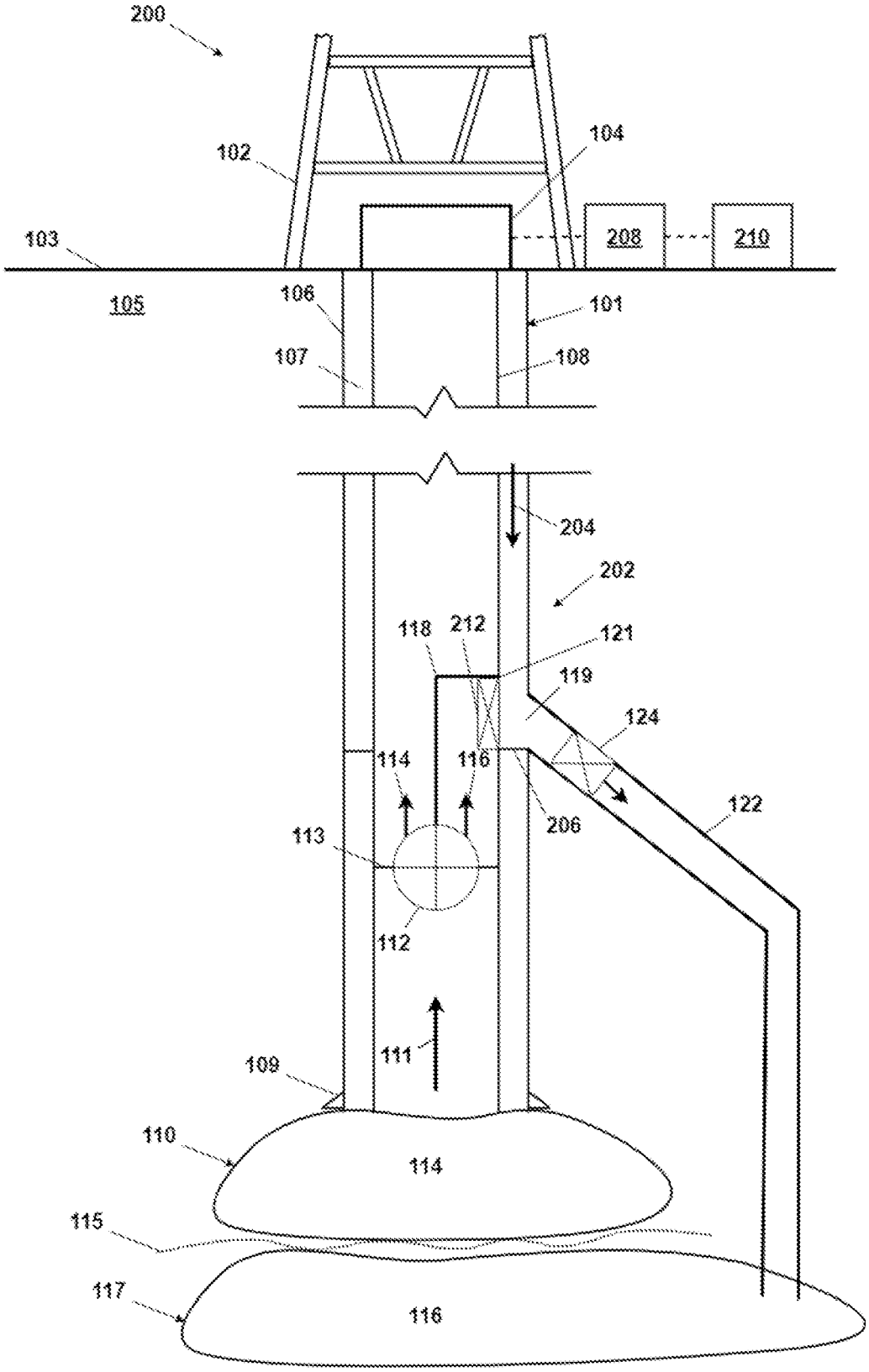
FIG. 2 is a schematic of another example production well system that may incorporate additional principles of the present disclosure.

FIG. 2 is a schematic of another example production well system 200 that may incorporate one or more principles of the present disclosure. The production well system 200 (hereafter "the system 200") may be similar in some respects to the system 100 of FIG. 1, and therefore may be best understood with reference thereto, where like numerals will represent like components not described again. Similar to the system 100, for example, the system 200 may include the wellbore 101 extending from the wellhead 104 and intersecting the subterranean formation 110. The production tubing 108 extends from the wellhead 104 and fluidly communicates with the production fluid 111 present within the subterranean formation 110. Moreover, the production fluid 111 may include hydrocarbons 114 mixed with portions of water 116 from the subterranean water source 117. The separator 112 may be arranged within the production tubing 108 to separate the hydrocarbons 114 from the water 116 and convey the separated hydrocarbon stream 114 to the surface 103, while conveying the separated water stream 116 into the lateral wellbore 122, as generally described above.

Unlike the system 100 of FIG. 1, however, the system 200 may include a water injector system 202 designed to inject (convey) additional or "surface" water 204 into the lateral wellbore 122 from the surface 103. A reservoir engineer, for example, may analyze the downhole separation process and may decide to optimize the flow (direction) of the separated water 116 flowing into the lateral wellbore 122 and to the subterranean water source 117. If the separated water 116 is not enough to maintain ongoing (steady) oil production inside the production tubing 108, it may be decided to inject surface water 204 into the lateral wellbore 122 from the surface 103 to supplement the water stream 116. Consequently, the lateral wellbore 122 may be used as a water injector path that extends to the subterranean water source 117.

As illustrated, the water injector system 202 may include an annulus guide 206 similar in some respects to the annulus guide 120 of FIG. 1. For example, the annulus guide 206 may be arranged within the annulus 107 and configured to extend between and fluidly connect the hole 121 in the production tubing 108 with the aperture 119 in the casing 106 such that the water 116 discharged from the separator 112 is able to be conveyed into the lateral wellbore 122. Unlike the annulus guide 120, however, the annulus guide 206 may be configured to receive the surface water 204 conveyed from the surface 103 within the annulus 107 and redirect the surface water 204 into the lateral wellbore 122 as part of the separated water stream 116. In such embodiments, the annulus guide 206 may be configured to separate the annulus 107 into two sections; one section uphole from the annulus guide 206, and a second section downhole from the annulus guide 206.

At the surface 103, the surface water 204 may be derived from a surface water source 208 in fluid communication with the wellhead 104. The surface water 204 may consist of fresh water, salt water, brine, and any combination thereof. As such, examples of the surface water source 208 include, but are not limited to, previously treated formation water storage, bodies of fresh water, bodies of salt water, and any combination thereof.

In some embodiments, the surface water 204 may be drawn into the annulus 107 from the surface water source 208 using pressure generated by the pump 124 located in the lateral wellbore 122. In other words, the pump 124 may be used to facilitate the injection process through suction generated during the process of pumping the separated water 116. Accordingly, the pressure of the surface water 204 will be supported by the pump 124 already installed in the proposed path to the subterranean water source 117. Using the pressure of the pump 124 may prove advantageous in helping to not disturb operation of the separator 112. In other embodiments, however, it is contemplated herein to use a surface pump 210 to help pump (convey) the surface water 204 into the annulus 107 as needed.

In some embodiments, the water injector system 202 may further include a one-way valve 212 arranged at the hole 121 defined in the production tubing 108 and otherwise at the outlet of the guide 118. The valve 212 may be configured to allow the separated water 116 to be discharged from the guide 118, while simultaneously preventing the surface water 204 from entering the guide 118 and thereby potentially disrupting operation of the separator 112.

The additional surface water 204 may be used to supplement the water 116 which has been extracted, and to increase the lift generated by water displacement that may be undertaken through the lateral wellbore 122 and the pump 124. In some applications, the injection of the surface water 204 may be performed without additional pumping at the surface 103 to prevent operational disruption of the separator 112. The supplementation of the water 116 with the additional surface water 204 may allow the revival of dead wells after retrofitting with the separator 112, the annulus guide 206, and the lateral wellbore 122. The proper handling of the water 116 produced downhole, as well as the increased flow of production fluid 111 resulting from water displacement may allow for wells designated as "dead" to resume production with higher performance.

While not shown herein, the systems 100, 200 may further include a control system in communication with the pump 124 or any downhole sensors that may be integrated with, or separate from, the pump 124. The control system may be configured to monitor the levels of water present in the extracted hydrocarbons 114, and the pump 124 may be operated in response to the quality of the hydrocarbons 114 such that the separator 112 is maintained at optimal operating conditions. Accordingly, the control system may be configured to control operation of the pump 124 if additional injection is needed to reach the desired flowrate of hydrocarbons 114 that are brought to the surface 103. Those skilled in the art will readily appreciate that the control system may perform additional control and feedback processes, and may be additionally included in the system 100 of FIG. 1, without departing from the scope of this disclosure.

Embodiments disclosed herein include:

A. A production well system that includes a main wellbore extending from a wellhead and penetrating a subterranean hydrocarbon-bearing formation, and a lateral wellbore extending from the main wellbore and production tubing arranged within the main wellbore and in fluid communication with a production fluid present in the subterranean hydrocarbon-bearing formation. The production well system further includes a separator arranged within the production tubing and operable to separate the production fluid into a hydrocarbon stream and a water stream, wherein the hydrocarbon stream is conveyed to the wellhead within the production tubing and the water stream is conveyed to the lateral wellbore, as well as a pump arranged uphole from the separator, the pump being operable to receive and convey the water stream into downhole portions of the lateral wellbore.

B. A method that includes receiving a production fluid from a subterranean formation into production tubing arranged within a main wellbore extending from a wellhead and penetrating the subterranean formation, and separating the production fluid into a hydrocarbon stream and a water stream using a separator arranged within the production tubing. The method further includes conveying the hydrocarbon stream to the wellhead within the production tubing, conveying the water stream into a lateral wellbore extending from the main wellbore, and receiving and conveying the water stream into downhole portions of the lateral wellbore with a pump arranged uphole from the separator.

Each of embodiments A and B may have one or more of the following additional elements in any combination: Element 1: further comprising a guide in fluid communication with and extending from the separator to convey the water stream into the lateral wellbore. Element 2: wherein the production tubing defines a hole axially aligned with an aperture defined in the casing and leading into the lateral wellbore, the production well system further comprising an annulus guide arranged within an annulus defined between the production tubing and the casing and extending between the hole and the aperture to convey the water stream from the guide and into the lateral wellbore. Element 3: further comprising a water injector system that conveys surface water into the lateral wellbore, the water injector system including a surface water source in fluid communication with the annulus via the wellhead, wherein the annulus guide is arranged to receive the surface water in the annulus and redirect the surface water into the lateral wellbore. Element 4: wherein pressure generated by the pump draws the surface water into the lateral wellbore from the annulus. Element 5: wherein the water injector system further includes a one-way valve arranged in the hole and operable to discharge the water stream from the guide, while simultaneously preventing the surface water from entering the guide. Element 6: wherein the annulus guide comprises an extension of the guide. Element 7: wherein the pump conveys the water stream into a subterranean water source in fluid communication with the subterranean hydrocarbon-bearing formation. Element 8: wherein the separator is a hydro-cyclonic or centrifugal separator, a gravity-based separator, a semi-permeable filter, or any combination thereof. Element 9: wherein the production tubing defines a hole axially aligned with an aperture defined in the casing and leading into the lateral wellbore, the method further comprising receiving and directing the water stream to the hole with a guide extending from the separator, and conveying the water stream from the guide and into the lateral wellbore with an annulus guide arranged within an annulus defined between the production tubing and the casing and extending between the hole and the aperture. Element wherein conveying the water stream into downhole portions of the lateral wellbore comprises conveying the water stream to a subterranean water source in fluid communication with the subterranean formation. Element 11: further comprising conveying surface water into the annulus from the a surface water source, and redirecting the surface water into the lateral wellbore with the annulus guide and thereby simultaneously conveying the water stream and the surface water to the subterranean water source. Element 12: further comprising drawing the surface water into the annulus and the lateral wellbore with the pump. Element 13: discharging the water stream from the guide with a one-way valve arranged in the hole, and preventing the surface water from entering the guide with the one-way valve.

By way of non-limiting example, exemplary combinations applicable to A and B include: Element 1 with Element 2; Element 2 with Element 3; Element 3 with Element 4; Element 2 with Element 5; Element 1 with Element 6; Element 7 with Element 8; Element 9 with Element 10; Element 10 with Element 11; Element 10 with Element 12; and Element 10 with Element 13.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, if used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A production well system, comprising:

a main wellbore extending from a wellhead and penetrating a subterranean hydrocarbon-bearing formation;

a lateral wellbore extending from the main wellbore;

production tubing arranged within the main wellbore and in fluid communication with a production fluid present in the subterranean hydrocarbon-bearing formation;

a separator arranged within the production tubing and operable to separate the production fluid into a hydrocarbon stream and a water stream, wherein the hydrocarbon stream is conveyed to the wellhead within the production tubing and the water stream is conveyed to the lateral wellbore; and a pump arranged uphole from the separator and operable to receive and convey the water stream into downhole portions of the lateral wellbore.

2. The production well system of claim 1, further comprising a guide in fluid communication with and extending from the separator to convey the water stream into the lateral wellbore.

3. The production well system of claim 2, wherein the main wellbore is lined with casing and the production tubing defines a hole axially aligned with an aperture defined in the casing and leading into the lateral wellbore, the production well system further comprising an annulus guide arranged within an annulus defined between the production tubing and the casing and extending between the hole and the aperture to convey the water stream from the guide and into the lateral wellbore.

4. The production well system of claim 3, further comprising a water injector system that conveys surface water into the lateral wellbore, the water injector system including a surface water source in fluid communication with the annulus via the wellhead, wherein the annulus guide is arranged to receive the surface water in the annulus and redirect the surface water into the lateral wellbore.

5. The production well system of claim 4, wherein the pump is located in the lateral wellbore and pressure generated by the pump draws the surface water into the lateral wellbore from the annulus.

6. The production well system of claim 3, wherein the water injector system further includes a one-way valve arranged in the hole and operable to discharge the water stream from the guide, while simultaneously preventing the surface water from entering the guide.

7. The production well system of claim 2, wherein the annulus guide comprises an extension of the guide.

8. The production well system of claim 1, wherein the pump conveys the water stream into a subterranean water source in fluid communication with the subterranean hydrocarbon-bearing formation.

9. The production well system of claim 8, wherein the separator is a hydro-cyclonic or centrifugal separator, a gravity-based separator, a semi-permeable filter, or any combination thereof.

10. A method, comprising:

receiving a production fluid from a subterranean formation into production tubing arranged within a main wellbore extending from a wellhead and penetrating the subterranean formation;

separating the production fluid into a hydrocarbon stream and a water stream using a separator arranged within the production tubing;

conveying the hydrocarbon stream to the wellhead within the production tubing;

conveying the water stream into a lateral wellbore extending from the main wellbore;

receiving and conveying the water stream into downhole portions of the lateral wellbore with a pump arranged uphole from the separator.

11. The method of claim 10, wherein the main wellbore is lined with casing and the production tubing defines a hole axially aligned with an aperture defined in the casing and leading into the lateral wellbore, the method further comprising:

receiving and directing the water stream to the hole with a guide extending from the separator; and conveying the water stream from the guide and into the lateral wellbore with an annulus guide arranged within an annulus defined between the production tubing and the casing and extending between the hole and the aperture.

12. The method of claim 11, wherein conveying the water stream into downhole portions of the lateral wellbore comprises conveying the water stream to a subterranean water source in fluid communication with the subterranean formation.

13. The method of claim 12, further comprising:

conveying surface water into the annulus from the a surface water source; and redirecting the surface water into the lateral wellbore with the annulus guide and thereby simultaneously conveying the water stream and the surface water to the subterranean water source.

14. The method of claim 12, wherein the pump is arranged within the lateral wellbore, the method further comprising drawing the surface water into the annulus and the lateral wellbore with the pump.

15. The method of claim 12, further comprising:

discharging the water stream from the guide with a one-way valve arranged in the hole; and preventing the surface water from entering the guide with the one-way valve.

* * * * *